US006809689B1

(12) United States Patent
Chen

(10) Patent No.: US 6,809,689 B1
(45) Date of Patent: Oct. 26, 2004

(54) MULTI-FREQUENCY ANTENNA FOR A PORTABLE ELECTRONIC APPARATUS

(75) Inventor: Farchien Chen, Taipei (TW)

(73) Assignee: Quanta Computer Inc., Tao-yuan Hsien (TW)

( * ) Notice: Subject to any disclaimer, the term of this patent is extended or adjusted under 35 U.S.C. 154(b) by 0 days.

(21) Appl. No.: 10/444,730

(22) Filed: May 20, 2003

(51) Int. Cl.[7] ..... H01Q 1/38
(52) U.S. Cl. ..... 343/700 MS; 343/702; 343/846
(58) Field of Search ..... 343/700 MS, 702, 343/846

(56) References Cited

U.S. PATENT DOCUMENTS 6,404,395 B1 * 6/2002 Masuda ..... 343/702
6,693,593 B1 * 2/2004 Burgess ..... 343/700 MS
2002/0126047 A1 * 9/2002 Laureanti ..... 343/700 MS

* cited by examiner

*Primary Examiner*—Hoang V. Nguyen
(74) *Attorney, Agent, or Firm*—Ladas & Parry LLP

(57) ABSTRACT

A multi-frequency antenna for a portable electronic apparatus includes a dielectric substrate mounted in a housing of the apparatus. A radiating element is disposed on a first surface of the substrate. A micro-strip conductor is disposed on an opposite second surface of the substrate and is coupled electrically to the radiating element. A grounding metal layer is disposed on the second surface of the substrate, is electrically isolated from the conductor, and is coupled electrically to the radiating element. A transmission line has a first conducting portion coupled electrically to the micro-strip conductor, and a second conducting portion coupled electrically to the grounding metal layer.

19 Claims, 9 Drawing Sheets

| Gain of H Plane | | |
|---|---|---|
| Frequency | | 2.45GHz |
| H | Peak | -3.75dBi |
| | Average | -10.43dBi |

| Gain of V Plane | | |
|---|---|---|
| Freguency | | 2.45GHz |
| V | Peak | -3.49dBi |
| | Average | -9.57dBi |

| Gain of H Plane | | |
|---|---|---|
| Frequency | | 5.25GHz |
| H | Peak | -9.91dBi |
| | Average | -15.78dBi |

| Gain of H Plane | | |
|---|---|---|
| Frequency | | 5.25GHz |
| V | Peak | -5.8dBi |
| | Average | -14.72dBi |

MULTI-FREQUENCY ANTENNA FOR A PORTABLE ELECTRONIC APPARATUS

BACKGROUND OF THE INVENTION

1. Field of the Invention

The invention relates to an antenna, more particularly to a multi-frequency antenna for a portable electronic apparatus.

2. Description of the Related Art

FIG. 1 illustrates conventional embedded antennas 8 according to U.S. Pat. No. 6,339,400. The antennas 8 are integrated on a display frame 71 of a portable computer. The following are some of the drawbacks of the conventional antennas 8:

1. The conventional antennas 8 must be accurately formed on the display frame 71, which results in a reduced yield.

2. The conventional antennas 8 are designed for a single frequency band, such as 2.4 GHz corresponding to the IEEE802.11b communications protocol.

SUMMARY OF THE INVENTION

Therefore, the object of the present invention is to provide a multi-frequency antenna for a portable electronic apparatus.

According to one aspect of the present invention, there is provided a multi-frequency antenna for a portable electronic apparatus having a housing. The antenna comprises:

a dielectric substrate adapted to be mounted in the housing and having opposite first and second surfaces;

a radiating element disposed on the first surface of the substrate;

a micro-strip conductor disposed on the second surface of the substrate and coupled electrically to the radiating element;

a grounding metal layer disposed on the second surface of the substrate, electrically isolated from the conductor, and coupled electrically to the radiating element; and a transmission line having a first conducting portion coupled electrically to the micro-strip conductor, and a second conducting portion coupled electrically to the grounding metal layer.

According to another aspect of the present invention, there is provided a multi-frequency antenna for a portable electronic apparatus having a housing. The antenna comprises a dielectric substrate adapted to be mounted in the housing and having opposite first and second surfaces, the substrate being formed with first and second conductive vias that extend from the first surface to the second surface;

a radiating element formed on the first surface of the substrate and having first and second radiator segments connected electrically and respectively to the first and second conductive vias;

a conductor layer formed on the second surface of the substrate and having opposite first and second end portions, the first end portion being coupled electrically to the first conductive via;

a grounding metal layer formed on the second surface of the substrate, electrically isolated from the conductor layer, and coupled electrically to the second conductive via; and a transmission line having a first conducting portion coupled electrically to the second end portion of the conductor layer, and a second conducting portion coupled electrically to the grounding metal layer.

According to a further aspect of the present invention, a portable electronic apparatus comprises:

a housing; and a multi-frequency antenna disposed in the housing and including a dielectric substrate mounted in the housing and having opposite first and second surfaces, a radiating element disposed on the first surface of the substrate, a micro-strip conductor disposed on the second surface of the substrate and coupled electrically to the radiating element, a grounding metal layer disposed on the second surface of the substrate, electrically isolated from the conductor, and coupled electrically to the radiating element, and a transmission line having a first conducting portion coupled electrically to the micro-strip conductor, and a second conducting portion coupled electrically to the grounding metal layer.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
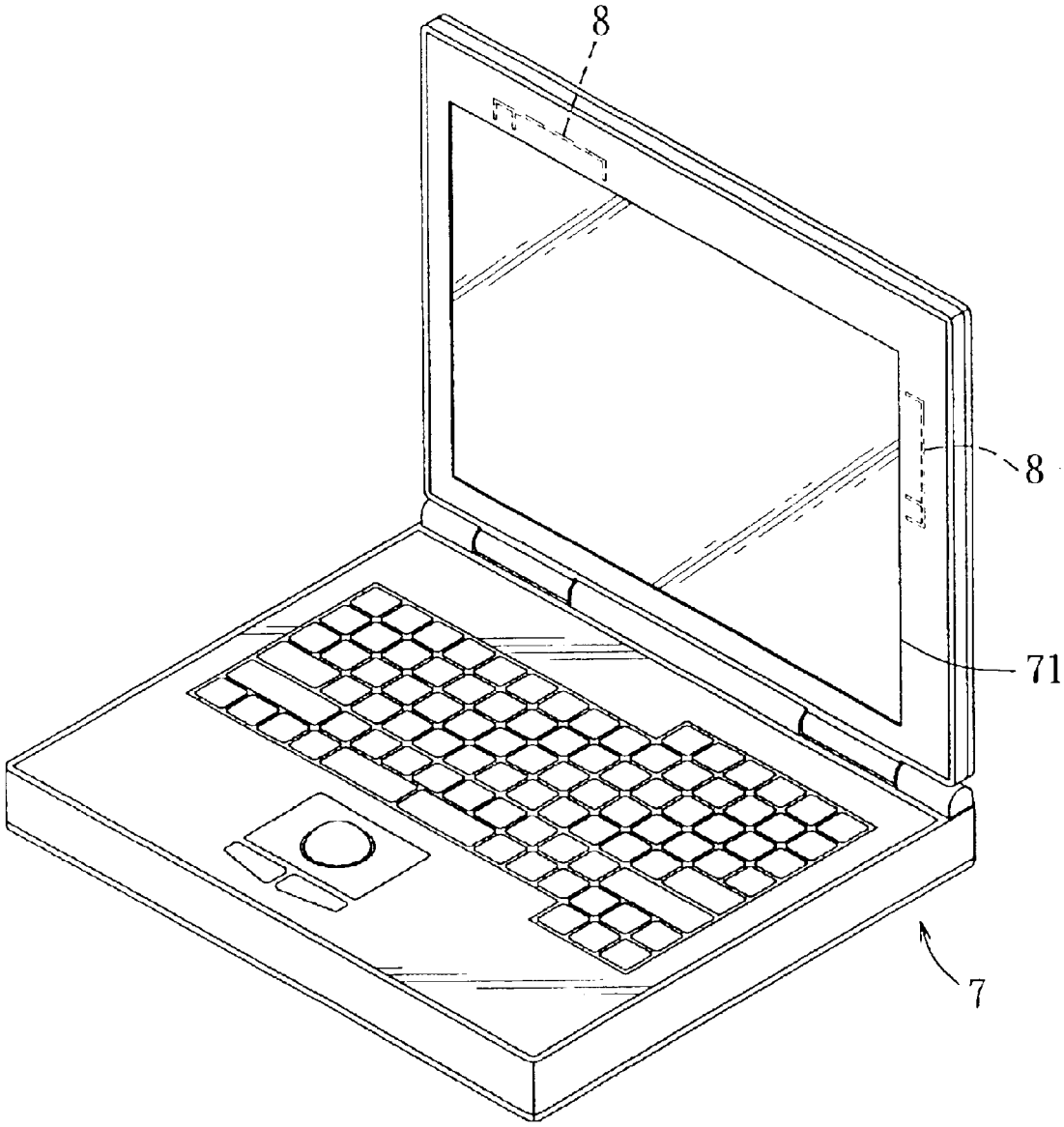
FIG. 1 PRIOR ART
FIG. 1 is a perspective view showing conventional antennas installed in a portable computer.
Figure 2:
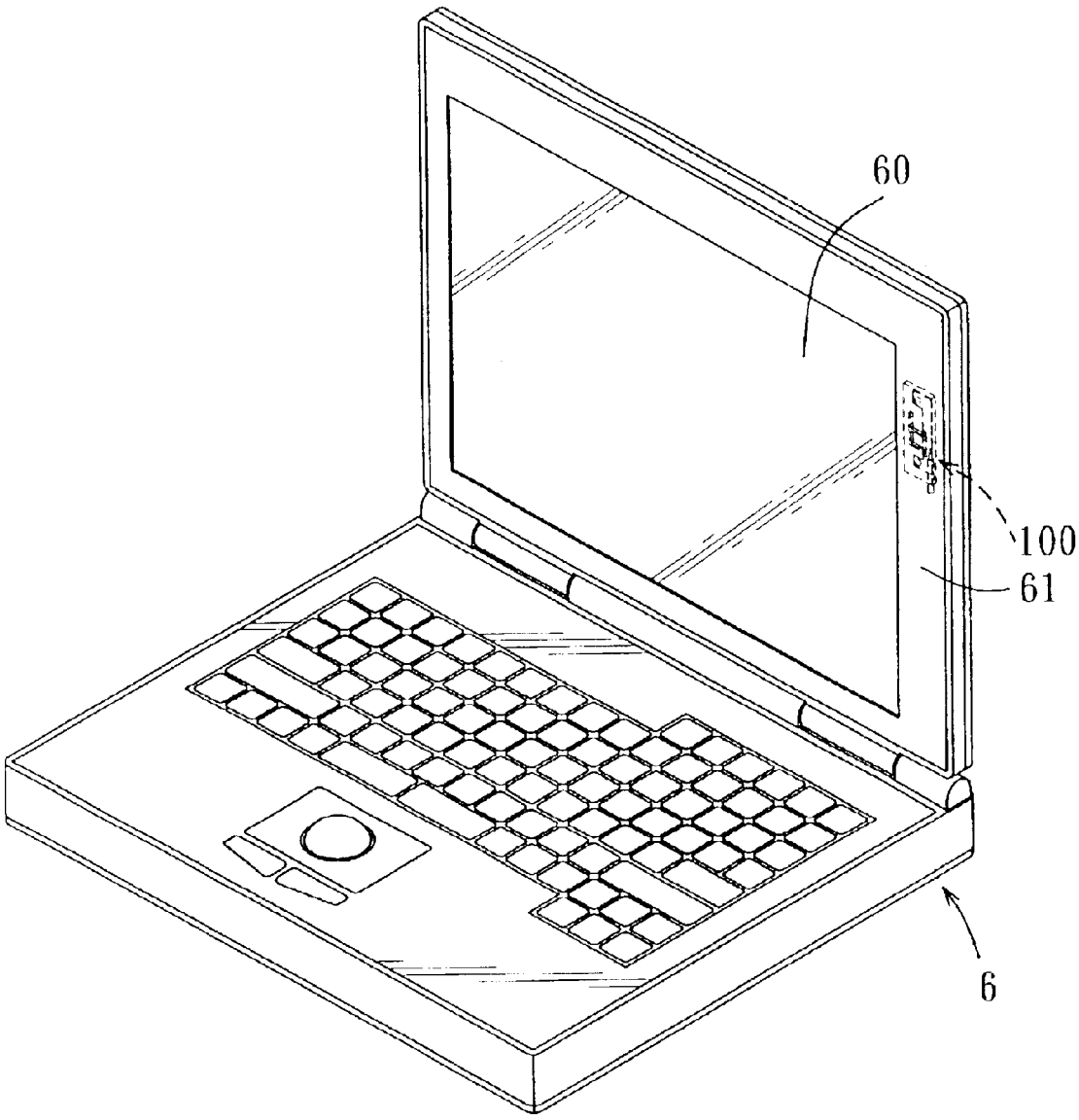
FIG. 2 is a perspective view showing a portable electronic apparatus with the preferred embodiment of a multi-frequency antenna according to the present invention.

Referring to FIG. 2, the preferred embodiment of a multi-frequency antenna 100 for a portable electronic apparatus 6, such as a notebook computer, having a housing 61 according to the present invention is shown to enable the portable electronic apparatus 6 to execute wireless communication according to IEEE802.11a and IEEE802.11b. The antenna 100 is also suitable for use in a personal digital assistant, a tablet personal computer or a pocket personal computer. In this embodiment, the housing 61 is provided with a display module 60 thereon.

Figure 3:
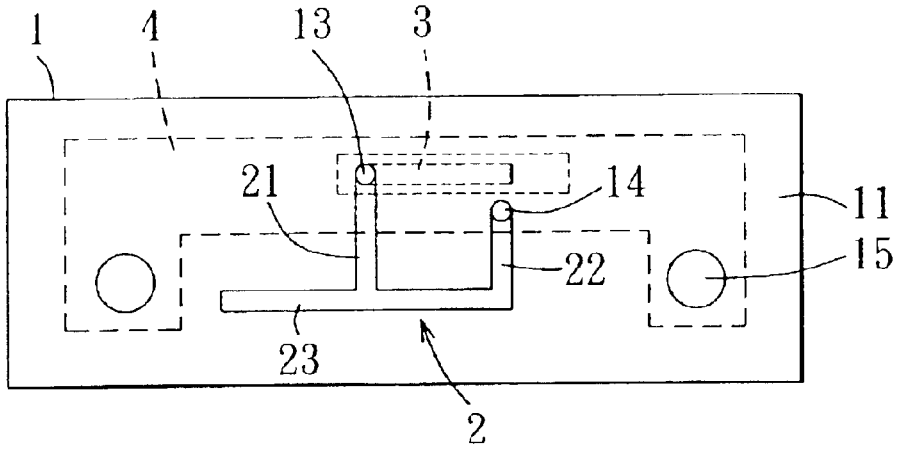
FIG. 3 is a schematic top view of the preferred embodiment.
Figure 4:
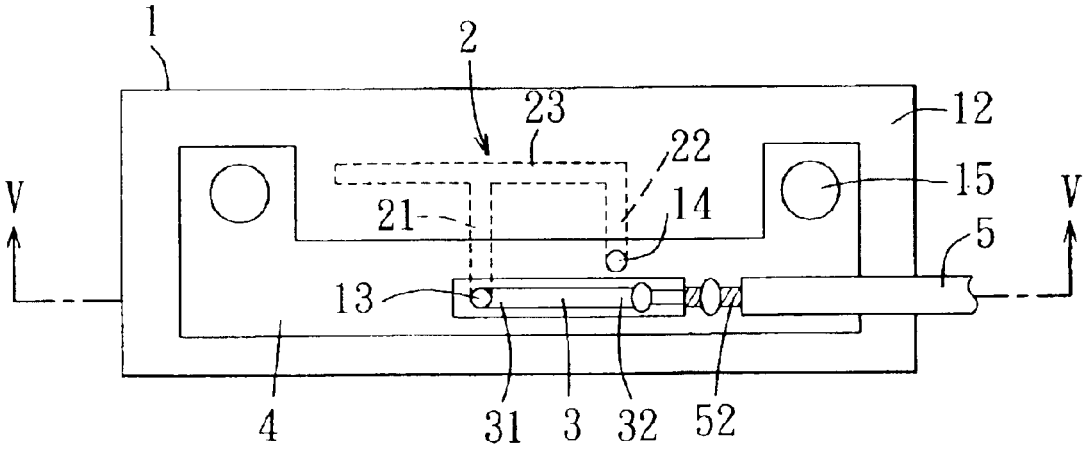
FIG. 4 is a schematic bottom view of the preferred embodiment.
Figure 5:
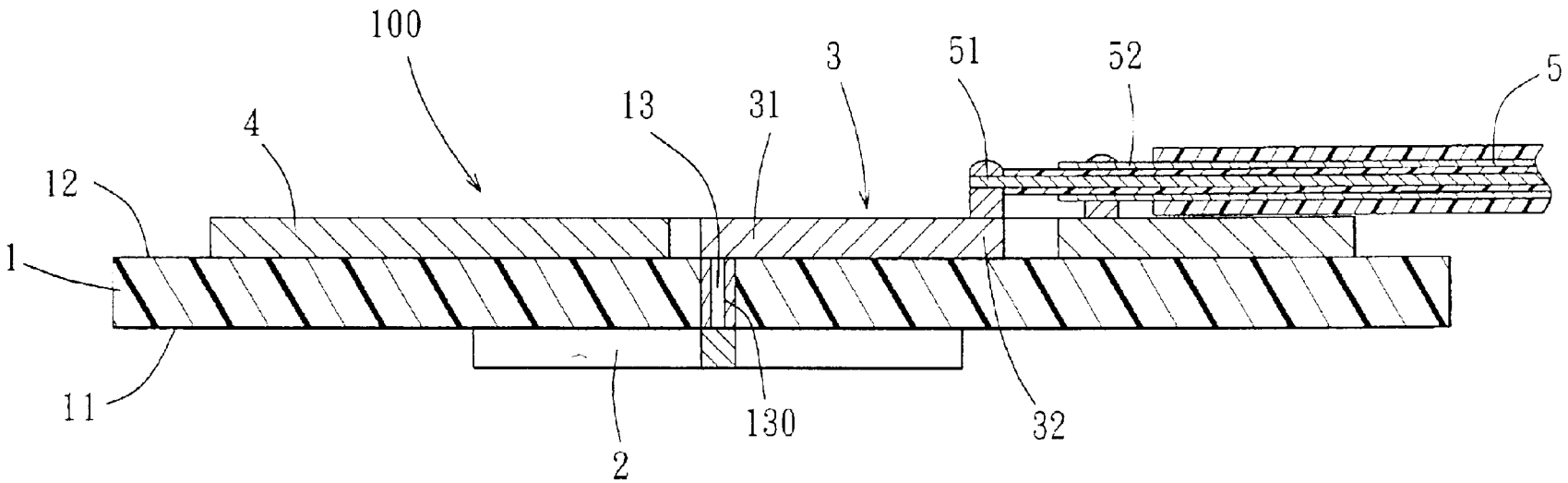
FIG. 5 is a schematic sectional view of FIG. 4 taken along line V—V.

Referring to FIGS. 3 to 5, the multi-frequency antenna 100 of the preferred embodiment is shown to include a dielectric substrate 1, a radiating element 2, a conductor layer 3, a grounding metal layer 4, and a transmission line 5.

The substrate 1 is adapted to be mounted in the housing 61 and has opposite first and second surfaces 11, 12. In this embodiment, the substrate 1 is a printed circuit board. The substrate 1 is formed with first and second conductive vias 13, 14 that extend from the first surface 11 to the second surface 12. Each of the first and second conductive vias 13, 14 is provided with a metal layer 130 coating therein as known in the art. Furthermore, the substrate 1 is formed with two screw holes 15. Two screw fasteners (not shown) extend respectively through the screw holes 15 and are used to fasten the substrate 1 onto the housing 61.

The radiating element 2 is formed on the first surface 11 of the substrate 1. In this embodiment, the radiating element 2 is a planar inverted-F antenna (PIFA), and has parallel first and second radiator segments 21, 22 connected electrically and respectively to the first and second conductive vias 13, 14, and a third radiator segment 23 transverse to and interconnecting the first and second radiator segments 21, 22 for impedance matching purposes.

The conductor layer 3 is formed on the second surface 12 of the substrate 1 and has opposite first and second end portions 31, 32. The first end portion 31 is coupled electrically to the first conductive via 13. As such, the first radiator segment 21 is connected electrically to the first end portion 31 of the conductor layer 3 through the first conductive via 13. In this embodiment, the conductor layer 3 is a micro-strip conductor that has predetermined width and length, for example, an optimal length of 4~-10 mm and an optimal width of 0.75 mm, for wireless communication.

The grounding metal layer 4, such as a thin metal plate, is formed on the second surface 12 of the substrate 1, and is electrically isolated from the conductor layer 3. As shown in FIG. 4, the grounding metal layer 4 surrounds the conductor layer 3, and is coupled electrically to the second conductor via 14. As such, the grounding metal layer 4 is connected electrically to the second radiator segment 22 of the radiating element 2 through the second conductive via 14.

The transmission line 5 has a first conducting portion 51 coupled electrically to the second end portion 32 of the conductor layer 3 by soldering, and a second conducting portion 52 coupled electrically to the grounding metal layer 4 by soldering. In this embodiment, the transmission line 5 is a coaxial cable. The first conducting portion 51 is an inner conductor, whereas the second conducting portion 52 is an outer conductor of the coaxial cable. As such, the radiating element 2 and the conductor layer 3 can be grounded through the transmission line 5.

Therefore, when the antenna 100 of the present invention radiates an electromagnetic wave, the first conducting portion 51 of the transmission line 5 transmits a frequency signal (e.g., a high frequency signal) from a radio frequency circuit (not shown) to the conductor layer 3 such that the conductor layer 3 and the radiating element 2 generate high frequency resonance so as to radiate the electromagnetic wave corresponding to the frequency signal. When the antenna 100 of the present invention receives an electromagnetic wave with a wavelength of $\lambda/4$, the conductor layer 3 and the radiating element 2 receive the electromagnetic wave and generate an induced current to the first conducting portion 51 of the transmission line 5.

Figure 6:
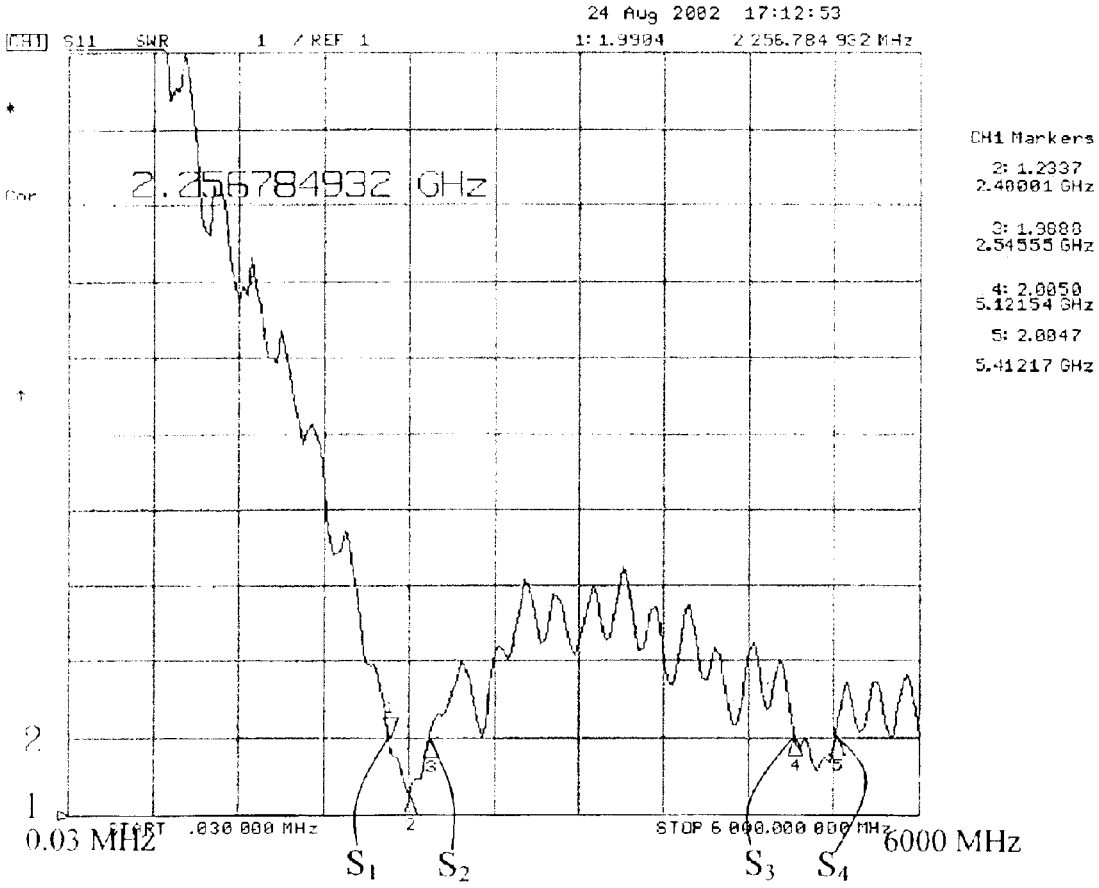
FIG. 6 shows a VSWR chart of the preferred embodiment.
Figure 7:
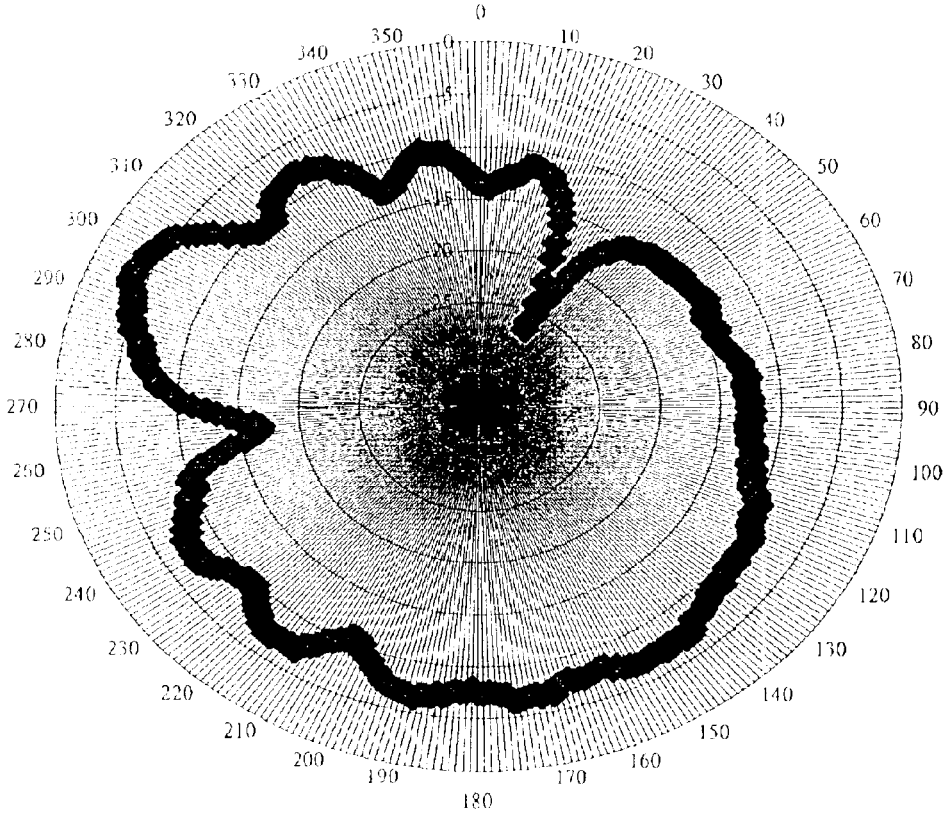
FIG. 7 shows a gain chart of the preferred embodiment in a horizontal plane at 2.45 GHz.
Figure 8:
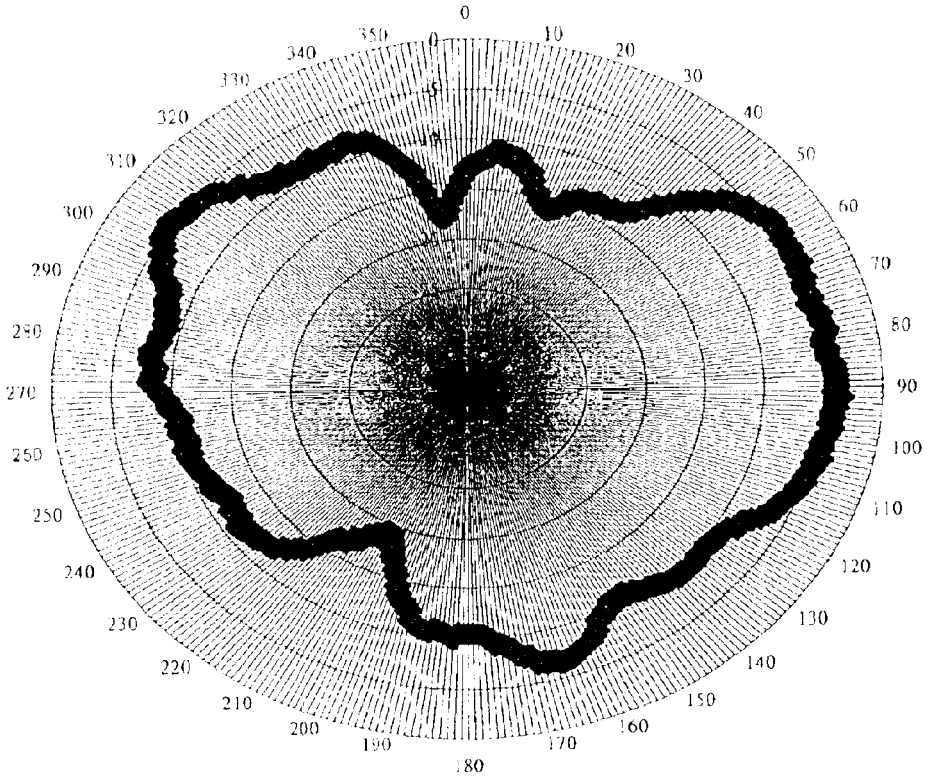
FIG. 8 shows a gain chart of the preferred embodiment in a vertical plane at 2.45 GHz.
Figure 9:
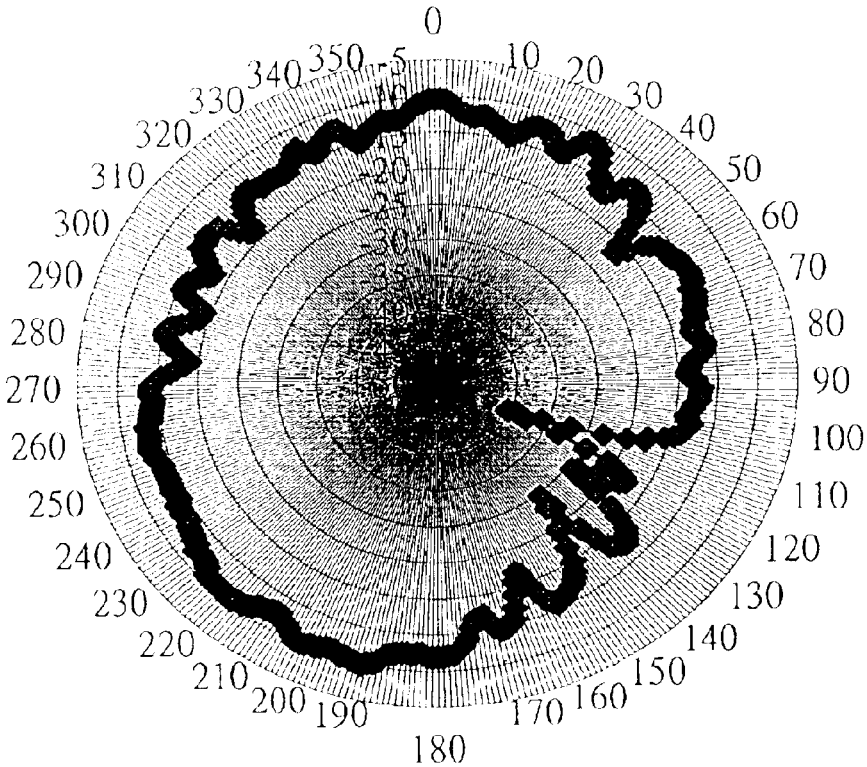
FIG. 9 shows a gain chart of the preferred embodiment in a horizontal plane at 5.25 GHz.
Figure 10:
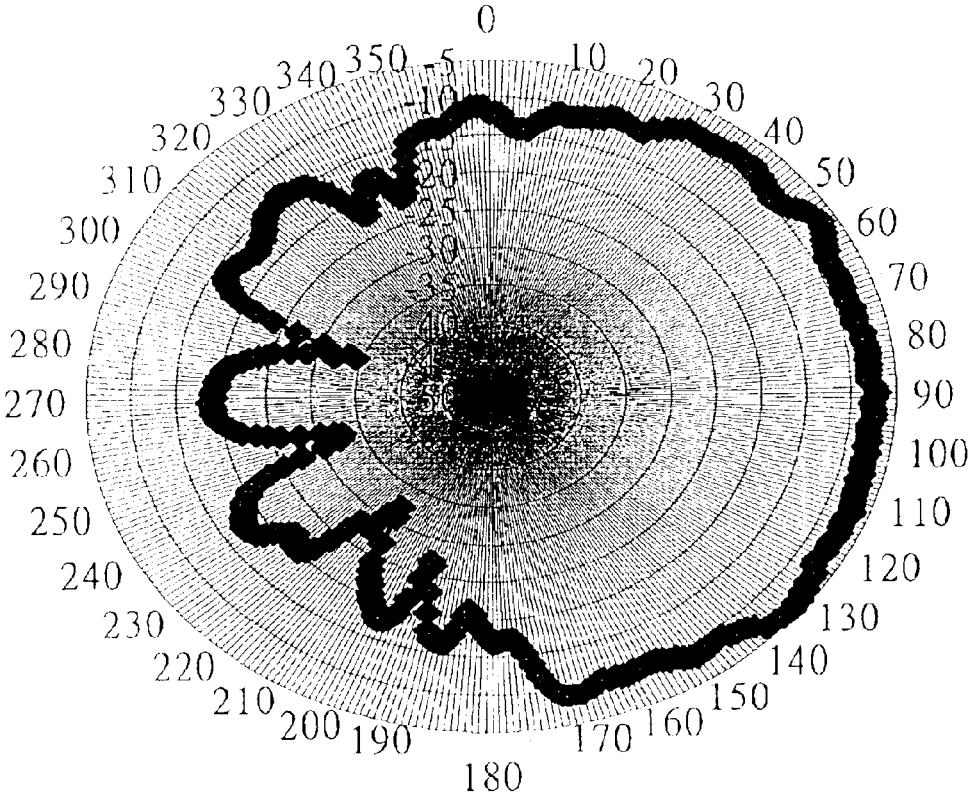
FIG. 10 shows a gain chart of the preferred embodiment in a vertical plane at 5.25 GHz.

FIG. 6 shows the measured voltage standing wave ratio (VSWR) for the antenna 100 of the present invention. In the chart, standing wave ratios at points S1, S2, S3, S4 are substantially equal to 2. The point S1 is located at 2.25 GHz, the point S2 is located at 2.54 GHz, the point S3 is located at 5.12 GHz, and the point S4 is located at 5.41 GHz. The resultant bandwidths are wide enough for the 2.4 GHz ISM band which has a bandwidth requirement of about 83.5 MHz and the 5.15 GHz ISM band which has a bandwidth requirement of about 200 MHz according to the IEEE802.11b and IEEE802.11a protocols. FIGS. 7 to 10 illustrate measured performances of the antenna 100 in horizontal and vertical planes at 2.4 GHz and 5.15 GHz.

It is noted that, through exposure, developing and etching processes, the radiating element 2, the conductor layer 3 and the grounding metal layer 4 can be formed precisely on the substrate 1 such that the antenna of this invention is suitable for mass-production. Furthermore, since the substrate 1 is fastened onto the housing 61, the transmission line 5 can be accurately soldered to the conductor layer 3 and the grounding metal layer 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-frequency antenna for a portable electronic apparatus having a housing, said antenna comprising:

a dielectric substrate adapted to be mounted in the housing and having opposite first and second surfaces;

a radiating element disposed on said first surface of said substrate;

a micro-strip conductor disposed on said second surface of said substrate and coupled electrically to said radiating element;

a grounding metal layer disposed on said second surface of said substrate, electrically isolated from said conductor, and coupled electrically to said radiating element; and a transmission line having a first conducting portion coupled electrically to said micro-strip conductor, and a second conducting portion coupled electrically to said grounding metal layer.

2. The multi-frequency antenna as claimed in claim 1, wherein said radiating element is a planar inverted-F antenna.

3. The multi-frequency antenna as claimed in claim 1, wherein said transmission line is a coaxial cable.

4. The multi-frequency antenna as claimed in claim 1, wherein said conductor has opposite end portions coupled electrically and respectively to said radiating element and said transmission line.

5. The multi-frequency antenna as claimed in claim 1, wherein said substrate is a printed circuit board.

6. The multi-frequency antenna as claimed in claim 1, wherein said substrate is formed with first and second conductive vias that extend from said first surface to said second surface, each of said first and second conductive vias connecting electrically said radiating element to a respective one of said conductor and said grounding metal layer.

7. A multi-frequency antenna for a portable electronic apparatus having a housing, comprising:

a dielectric substrate adapted to be mounted in the housing and having opposite first and second surfaces, said substrate being formed with first and second conductive vias that extend from said first surface to said second surface;

a radiating element formed on said first surface of said substrate and having first and second radiator segments connected electrically and respectively to said first and second conductive vias;

a conductor layer formed on said second surface of said substrate and having opposite first and second end portions, said first end portion being coupled electrically to said first conductive via;

a grounding metal layer formed on said second surface of said substrate, electrically isolated from said conductor layer, and coupled electrically to said second conductive via; and a transmission line having a first conducting portion coupled electrically to said second end portion of said conductor layer, and a second conducting portion coupled electrically to said grounding metal layer.

8. The multi-frequency antenna as claimed in claim 7, wherein said radiating element is a planar inverted-F antenna that further has a third radiator segment interconnecting said first and second radiator segments.

9. The multi-frequency antenna as claimed in claim 7, wherein said conductor layer is a micro-strip conductor.

10. The multi-frequency antenna as claimed in claim 7, wherein said transmission line is a coaxial cable.

11. The multi-frequency antenna as claimed in claim 7, wherein said substrate is a printed circuit board.

12. A portable electronic apparatus comprising:

a housing; and a multi-frequency antenna disposed in said housing and including a dielectric substrate mounted in said housing and having opposite first and second surfaces, a radiating element disposed on said first surface of said substrate, a micro-strip conductor disposed on said second surface of said substrate and coupled electrically to said radiating element, a grounding metal layer disposed on said second surface of said substrate, electrically isolated from said conductor, and coupled electrically to said radiating element, and a transmission line having a first conducting portion coupled electrically to said micro-strip conductor, and a second conducting portion coupled electrically to said grounding metal layer.

13. The portable electronic apparatus as claimed in claim 12, wherein said radiating element is a planar inverted-F antenna.

14. The portable electronic apparatus as claimed in claim 12, wherein said transmission line is a coaxial cable.

15. The portable electronic apparatus as claimed in claim 12, wherein said conductor has opposite end portions coupled electrically and respectively to said radiating element and said transmission line.

16. The portable electronic apparatus as claimed in claim 12, wherein said substrate is a printed circuit board.

17. The portable electronic apparatus as claimed in claim 12, wherein said substrate is formed with first and second conductive vias that extend from said first surface to said second surface, each of said first and second conductive vias connecting electrically said radiating element to a respective one of said conductor and said grounding metal layer.

18. The portable electronic apparatus as claimed in claim 12, further comprising a display module mounted on said housing.

19. The portable electronic apparatus as claimed in claim 12, further comprising screw fasteners for fastening said substrate onto said housing.

* * * * *